United States Patent [19]

Suzuki et al.

[11] 4,352,876

[45] Oct. 5, 1982

[54] COMPLEX TYPE ELECTROPHOTOGRAPHIC PLATE AND ELECTROPHOTOGRAPHIC METHOD USING THE SAME

[75] Inventors: Shigeo Suzuki, Hitachi; Atsushi Kakuta, Hitachiota; Hiroyuki Oka, Hitachi; Yasuki Mori, Hitachi; Hirosada Morishita, Hitachi, all of Japan

[73] Assignee: Hitachi, Ltd., Tokyo, Japan

[21] Appl. No.: 186,651

[22] Filed: Sep. 12, 1980

[30] Foreign Application Priority Data

Sep. 14, 1979 [JP] Japan ..... 54-117308

[51] Int. Cl.[3] ..... G03G 5/02; G03G 5/14

[52] U.S. Cl. ..... 430/58; 430/59; 430/72; 430/900

[58] Field of Search ..... 430/59, 72, 900, 58

[56] References Cited

U.S. PATENT DOCUMENTS 3,764,590 10/1973 Mukoh et al. ..... 430/71 X
3,928,034 12/1975 Regensberger ..... 430/58 X

FOREIGN PATENT DOCUMENTS 2846081 5/1979 Fed. Rep. of Germany ..... 430/59
53-9536 1/1978 Japan .

OTHER PUBLICATIONS

Schlosser, J. of Applied Photog. Eng., vol. 4, No. 3 (1978), pp. 118–122.

*Primary Examiner*—J. David Welsh
*Attorney, Agent, or Firm*—Antonelli, Terry & Wands

[57] ABSTRACT

A complex type electrophotographic plate comprising an electroconductive support and a charge generating layer and a charge transport layer characterized in that the charge generating layer contains at least a copper phthalocyanine and the charge transport layer contains at least a trinitrofluorenone, has excellent photosensitivity and adhesion to the support. There is also provided an electrophotographic method comprising a first step of charging an electrophotographic plate, a second step of exposing the electrophotographic plate to light and a third step of developing an electrostatic latent image formed on the electrophotographic plate directly or the electrostatic latent image transferred to a recording medium, characterized by using in the first step, as the electrophotographic plate, a complex type electrophotographic plate having a charge generating layer containing at least a copper phthalocyanine and a charge transport layer containing at least a nitrofluorenone and charging said electrophotographic plate positively with excellent recording properties.

19 Claims, 2 Drawing Figures

COMPLEX TYPE ELECTROPHOTOGRAPHIC PLATE AND ELECTROPHOTOGRAPHIC METHOD USING THE SAME

This invention relates to a complex type electrophotographic plate comprising a support material and a charge generating layer and a charge transport layer and an electrophotographic method using the same.

Heretofore, as a complex type electrophotographic plate, there is known one containing a phthalocyanine as a charge generating layer and a nitrated fluorenone admixed with a polyvinyl carbazole series binder as a charge transport layer (Japanese Patent Appln Kokai (Laid-Open) No. 9536/78), but since a large amount of polyvinyl carbazole is used as a binder, such a complex type electrophotographic plate has a defect in that the charge generating layer and the charge transport layer are easily peeled off from an electroconductive support due to poor adhesiveness.

It is a major object of this invention to provide a complex type electrophotographic plate having excellent photosensitivity and an electrophotographic method excellent in recording properties.

Figure 1:
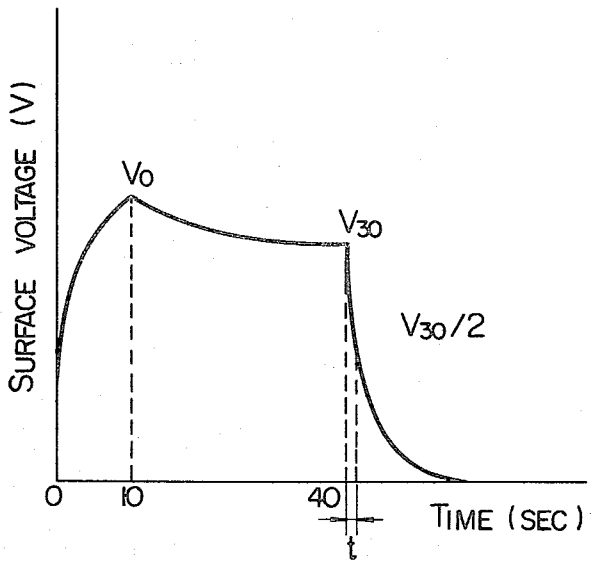
Figure 2:
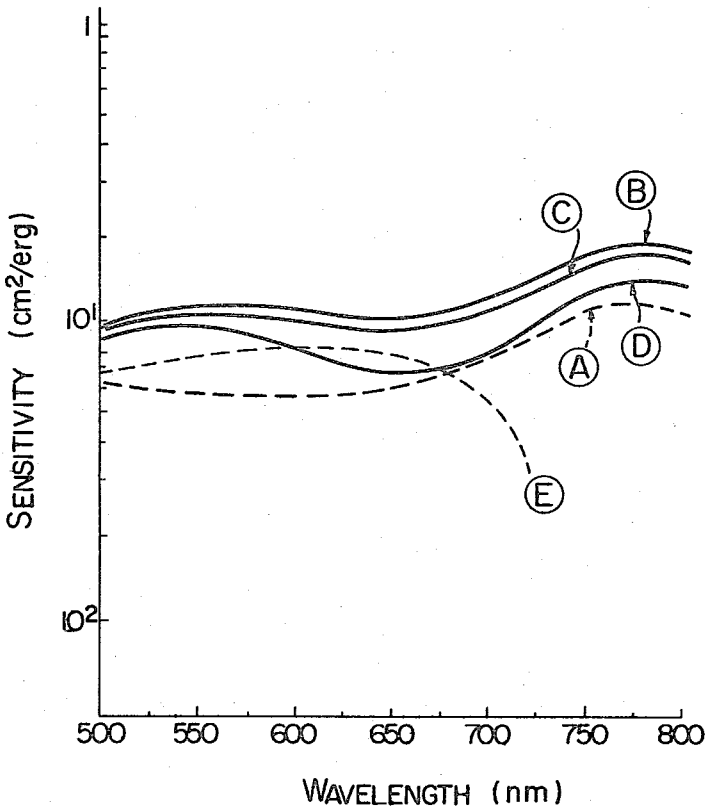

In the attached drawings, FIG. 1 is a graph showing a change of surface voltage of a complex type electrophotographic plate with the lapse of time and being usuful as calculation basis for half decay exposure sensitivity, and FIG. 2 is a graph showing a relationship between sensitivity and wavelength in the electrophotographic plates used in Example 10.

This invention provides a complex type electrophotographic plate comprising an electroconductive support and a photosensitive material layer containing a charge generating layer and a charge transport layer formed on the support, characterized in that the charge generating layer contains a copper phthalocyanine and the charge transport layer contains a nitrofluorenone.

This invention also provides an electrophotographic method comprising a first step of charging an electrophotographic plate, a second step of exposing the electrophotographic plate to light and a third step of developing an electrostatic latent image formed on the electrophotographic plate directly or the electrostatic latent image transferred to a recording medium, characterized by using in the first step, as the electrophotographic plate, a complex type electrophotographic plate having a charge generating layer containing a copper phthalocyanine and a charge transport layer containing a nitrofluorenone and charging said electrophotographic plate positively.

As the copper phthalocyanine, which is a charge generating material, used in the charge generating layer, there can be used any crystalline forms, $\alpha$, $\beta$, $\gamma$, $\epsilon$ or X form, and among the, $\epsilon$-form copper phthalocyanine is more effective.

The charge generating layer becomes more effective, when a mixture of a copper phthalocyanine and at least one azo pigment selected from monoazo lake pigments, disazo pigments and the like is used as a charge generating material. In such a case, not only a photosensitive wavelength range is broadened but also photosensitivity at a long wavelength red spectral range increases about 1.5 to 2 times as much as the case of using a copper phthalocyanine alone; this is a very special effect. Better photosensitivity is not simply dependent on the thickness of a charge generating material layer. Details are still unknown as to causes for increasing photosensitivity, but better photosensitivity seems to be obtained when the two pigments have affinity each other, these pigments can form a more uniform layer than copper phthalocyanine, and the generation of light carriers becomes better at the time of exposure to light. Mixing ratio of the above-mentioned charge generating materials is perferable when 1 part by weight of the copper phthalocyanine is mixed with 0.1 to 10 parts by weight of the azo pigment considering spectral sensitivity to longer wavelength side and discharge properties in the dark. (Decaying properties of surface potential in the dark are termed "dark decay".)

The charge generating layer can be formed, for example, by adding an organic solvent, and if necessary, a resin binder for electrophotography, to the charge generating material or materials mentioned above, grinding them finely, for example to a particle size of 5 $\mu$m or less, particularly 1 $\mu$m or less by ball milling or roll milling to give a coating solution of the charge generating material(s), and coating the solution on an electroconductive support directly or by interposing a barrier layer mentioned hereinafter by using a coating machine, etc.

As the azo pigments mentioned above, there can be used at least one compound among the following compounds, for example, represented by the formulae:

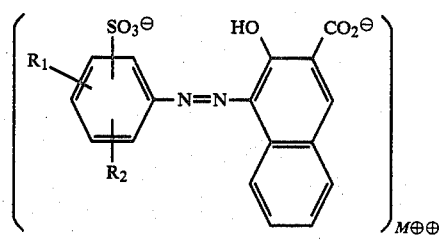

(I)

wherein M is Ca, Ba or Mg; and $R_1$ and $R_2$ are independently hydrogen, $-OCH_3$ or halogen;

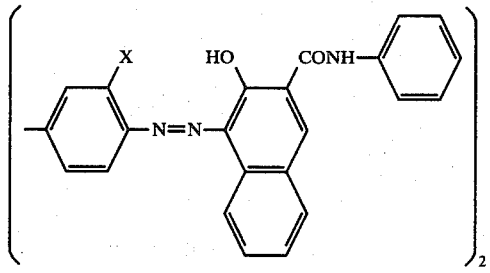

(II)

wherein X is $-OCH_3$ or Cl.

As resins used for the resin binder, there can be used polycarbonate resins, acrylic resins, polyester resins, butyral resins, polyketone resins, polyurethane resins, and the like. These resins can be used alone or as a mixture thereof. The amount of the resin to be added is within the range not to give bad influence on practical photosensitivity and generally 4 parts by weight or less per part by weight of the charge generating material mentioned above.

When the organic solvent is used, there can be used tetrahydrofuran, dioxane, cyclohexane, chloroform, dichloromethane, 1,2-dichloroethane, benzene, toluene, xylene, or a mixture thereof.

The thickness of the charge generating layer can be determined by considering photosensitivity required, mechanical properties of the layer, or mixing ratio of the charge generating material and the resin binder, but usually is 20 μm or less, and preferably in the range of 0.1 to 5 μm.

As the charge transport material which is used for forming the charge transport layer, there can be used nitrofluorenones such as 2,4,7-trinitrofluorenone, 2,5-dinitrofluorenone, 2,6-dinitrofluorenone, 3,6-dinitrofluorenone, 2,7-dinitrofluorenone, 2,4,5,7-tetranitrofluorenone, and the like. These nitrofluorenones can be used alone or as a mixture thereof.

When at least one nitrofluorenone mentioned above is mixed with a homopolymer of a polycyclic aromatic vinyl compound of the formula:

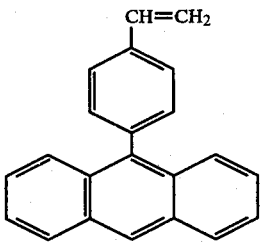

(III)

or a copolymer of the vinyl compound of the formula (III) with one or more other vinyl comonomers, or its brominated homopolymer or copolymer to give a charge transport material, which is used in combination with the charge generating layer mentioned above, the resulting complex type electrophotographic plate shows particularly excellent properties, e.g. highly sensitive to wavelengths longer than 750 nm or more, and having sufficient flexibility. Examples of copolymers of the vinyl compound of the formula (III) are 9-(p-vinylphenyl)-anthracene-N-vinyl carbazole copolymer, 9-(p-vinylphenyl)anthracene-styrene copolymer, 9-(p-vinylphenyl)-anthracene-acrylonitrile copolymer, 9-(p-vinylphenyl)-anthracene-acrylate copolymers, 9-(p-vinylphenyl)-anthracene-methacrylate copolymers, etc. Further, such a complex type electrophotographic plate shows excellent photosensitivity at a time of positively charged compared with a time of negatively charged.

The polycyclic aromatic vinyl polymers mentioned above are disclosed in U.S. Pat. No. 3,764,590.

Mixing ratio of the nitrofluorenone to the polycyclic aromatic vinyl polymer can be selected from a wide range and usually 0.3 to 10 parts by weight of the polycyclic aromatic vinyl polymer is used per part by weight of the nitrofluorenone. In any case, the mixing ratio is determined by considering balance in sensitivity, initial potential (or voltage) and dark decay properties.

The charge transport layer can be formed in the same manner as mentioned as to the formation of the charge generating layer. When an organic solvent or a resin binder is used, the same one as mentioned above can be used. In the case of using a resin binder, it is desirable to determine the mixing ratio considering sensitivity, residual voltage after exposure, or the like. In this invention, a relatively broad range of the mixing ratio can be selected, but in general it is proper to use 10 parts by weight or less, more preferably 3 parts by weight or less of the resin binder per part by weight of the charge transport material.

The thickness of the charge transport layer can be determined properly by considering charging characteristics necessary for the electrophotographic plate, but usually is 3 to 100 μm, and more preferably in the range of 5 to 50 μm.

In this invention, a small amount of plasticizer can be added to either one or both of the charge generating layer and the charge transport layer. The adding amount is in the range not to damage the object of this invention, and preferably 30% by weight or less based on the weight of the each layer. As the plasticizers, there can be used conventional ones such as terphenyls, phosphoric acid esters, phthalic acid esters, poly-N-vinyl carbazole, and the like.

As the electroconductive support used in the complex type electrophotographic plate of this invention, there can be used brass, aluminum, gold, copper, and the like in proper thickness and proper hardness, or in the form of flexible sheet, thin plate or cylinder or those coated with a plastic thin film. There can also be used metal coated paper, metal coated plastic sheet, or glass coated with a thin film of aluminum iodide, copper iodide, indium oxide or tin oxide. The support usually has electroconductivity by itself or has a electroconductive surface and also has sufficient strength to be handled.

If necessary, a barrier layer can be formed on the electroconductive support or between the charge generating layer and the charge transport layer. An object of interposing the barrier layer is to prevent unnecessary injection of charge from the electroconductive support and to maintain proper transfer of charge. Another object of interposing the barrier layer is to improve stickness between the photoconductive layer and the support and to provide flexibility to the photoconductive layer. Therefore, the material which constitutes the barrier layer should have functions to attain such objects mentioned above and at the same time should not remarkably lower other properties such as residual voltage, sensitivity, and the like. The thickness of the barrier layer is usually 2 μm or less. As the barrier layer materials, there can be used conventional ones such as oxides and fluorides of transition metals, e.g., $CeO_2$, $ZrO_2$, $Y_2O_3$, $Al_2O_3$, $TiO_2$, $CeF_2$, $MgF_2$, etc., polymers, e.g., polyvinyl alcohol, polyimide resins, polyamide-imide resins, polycarbonate resins, acrylic resins, polyester resins, butyral resins, polyketone resins, polyurethane resins, etc.

The complex type electrophotographic plate of this invention has a broad photosensitive wavelength range and is excellent in repetition characterisitics and durability, and particularly is characterized in showing high sensitivity at a time of positively charged.

This invention is illustrated by way of the following Examples, in which all parts and percents are by weight unless otherwise specified.

EXAMPLE 1

One part of β-form copper phthalocyanine (Fastogen Blue FGF, manufactured by Dainippon Ink and Chemicals, Inc., Japan), 1 part of the disazo pigment of the formula:

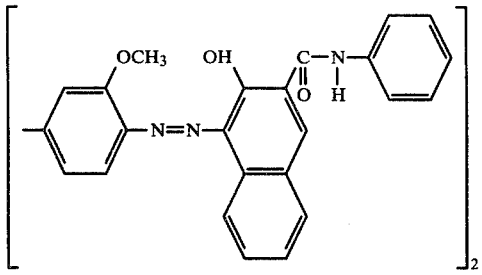

(Symular Fast Blue 4135, manufactured by Dainippon Ink and Chemicals, Inc., Japan) and 1 part of a butyral resin (XYHL, manufactured by Union Carbide Corp., U.S.A.) were mixed with xylene as a solvent so as to give a 6% solution and kneaded in a ball mill (a pot having a diameter of 10 cm, manufactured by Nippon Kagaku Togyo Co., Ltd., Japan) for 5 hours to give a charge generating material solution. This solution was coated on an aluminum foil of 100 μm thick by using an automatic applicator (manufactured by Toyo Seiki Co., Ltd., Japan) to give a charge generating layer having a thickness of about 3 μm after dried. Then a charge transport material solution was prepared by mxing 0.15 part of a charge transport material, 2,4,7-trinitrofluorenone (manufactured by Tokyo Kasei Co., Ltd., Japan, hereinafter referred to as "TNF"), 0.32 part of a polycarbonate resin (Iupilon S-2000, manufactured by Mitsubishi Gas-Chemical Co., Inc., Japan), 0.003 part of dichloromethane and 0.001 part of 1,2-dichloroethane. In order to give a uniform coating, it was better to dissolve the resin component completely first followed by the addition of the charge transport material. The resulting coating solution was coated on the charge generating layer mentioned above by using the automatic applicator. The formed charge transport layer had a thickness of about 10 μm.

Electrophotographic properties of the resulting complex type electrophotographic plate were evaluated by using an electrostatic recording paper analyzer (SP-428 made by Kawaguchi Electric Works Co., Ltd., Japan). The electrophotographic plate was charged by conducting positive corona discharge at 5 kV for 10 seconds (the surface voltage immediately after the 10 seconds' charge was defined as the initial voltage $V_o$ (V)) and then allowed to stand in the dark for 30 seconds (the surface voltage at that time was represented by $V_{30}$ (V) and the dark decay was obtained by $V_{30}/V_0 \times 100\%$). Subsequently, the electrophotographic plate was exposed to light from a tungsten lamp with 20-lux illuminance at the surface. Decay of the surface voltage and its time were recorded and white light sensitivity (half decay exposure sensitivity, $E_{50}$ in lux-second) was expressed by the product of a time required for decreasing to a half of $V_{30}$ (t in seconds) and illuminance. The spectral light-sensitivity ($cm^2/erg$) was expressed by the reciprocal value of $E_{50}$ (energy at each spectrum, $\mu W/cm^2$). Such a relationship can be shown in FIG. 1.

As a result, the complex type electrophotographic plate of this Example had electrophotographic properties of an initial voltage of about 700 V, dark decay of 63%, and white light sensitivity of 3.4 lux-second, these values having no problem for practical use.

In the next place, the electrophotographic plate was charged in the dark with 5 kV positively for 10 seconds, exposed to scanning beams from a semiconductor laser of power 5 mW and wavelength 800 nm, and developed by using a cascade method to give a clear visible image.

EXAMPLE 2

A charge generating layer having a thickness of 3 μm was formed in the same manner as described in Example 1 but changing the mixing ratio of charge generating materials ϵ-form copper phthalocyanine (Lionol Blue ESP, manufactured by Toyo Ink Co., Ltd., Japan) and the disazo pigment of the formula:

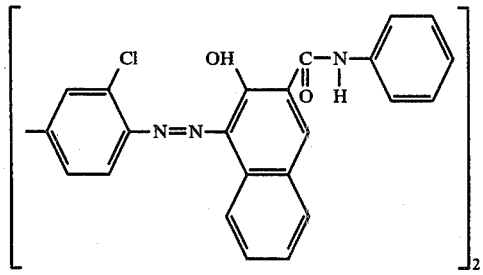

as shown in Table 1, using 1 part of the butyral resin per 2 parts of the charge generating material and using xylene as a solvent. A charge transport material solution was prepared by mixing 0.3 part of 2,4,7-trinitrofluorenone, a charge transport material, 0.3 part of a saturated polyester resin (Vylon 200, manufactured by Toyobo Co., Ltd., Japan), 0.003 part of dichloromethane and 0.001 part of 1,2-dichloroethane. The coating solution was coated on the charge generating layer mentioned above by using the applicator and dried to give a charge transport layer having a thickness of 10 μm.

Electrophotographic properties against white light of the thus produced complex type electrophotographic plates were evaluated in the same manner as described in Example 1. The results were as shown in Table 1. For comparison, properties when each charge generating material was used alone for forming the charge generating layer were also evaluated.

TABLE 1

| Mixing ratio of charge generating materials (weight ratio) | | Initial voltage (V) | Dark decay (%) | Sensitivity (lux-sec) |
|---|---|---|---|---|
| ϵ-Form copper phthalocyanine | Disazo pigment | | | |
| 4 | 0 | 565 | 55 | 5.0 |
| 3 | 1 | 590 | 59 | 2.2 |
| 2 | 2 | 615 | 63 | 2.7 |
| 1 | 3 | 573 | 67 | 3.2 |
| 0 | 4 | 608 | 70 | 4.0 |

EXAMPLE 3

After preparing a charge generating material solution by mixing 1 part of β-form copper phthalocyanine (Heliogen Blue 7080, manufactured by BASF A.G., West Germany), 0.5 part of the same disazo pigment as used in Example 2, and 0.5 part of an acrylic resin (Elvacite 2045, manufactured by E. I. du Pont de Nemours Co., U.S.A.) and adding xylene as a solvent using the same manner as described in Example 1, a charge generating layer having a thickness of about 2.5 μm was formed in the same manner as described in Example 1. Subsequently a charge transport layer was formed in the same manner as described in Example 2 to give a complex type electrophotographic plate.

The complex type electrophotographic plate had electrophotographic properties of an initial voltage of 580 V, dark decay of 60%, and white light sensitivity of 2.8 lux-second, these values having no problem for practical use. Further, when the image forming test was conducted in the same manner as described in Example 1, a clear image was obtained.

EXAMPLE 4

To 1.5 parts of β-form copper phthalocyanine (Cyanine Blue LC, manufactured by Dainippon Ink and Chemicals, Inc., Japan) and 0.5 part of the same disazo pigment as used in Example 1, diethylamine was added to give a 7% (by weight) charge generating material solution. After sufficiently dispersing the charge generating materials in the solution by using ultrasonic vibration, the resulting coating solution was coated on an aluminum foil by using an applicator in the same manner as described in Example 1 and sufficiently dried to give a charge generating layer having a thickness of about 2 μm. A charge transport layer was formed in the same manner as described in Example 2 to give a complex type electrophotographic plate.

The complex type electrophotographic plate had electrophotographic properties of an initial voltage of 615 V, dark decay of 59% and white light sensitivity of 2.4 lux-second, these values having no problem for practical use. Further, when the image forming test was conducted in the same manner as described in Example 1 by using a semiconductor laser, a clear image was obtained. Further, when the electrophotographic plate was subjected to charging and exposure (to white light) test in order to measure changes of the properties, lowering in the initial voltage was less than 10%, lowering in the dark decay was less than 10% and almost no lowering was observed in the sensitivity, after 1000 times of the repetition. This means that the electrophotographic plate is durable over 1000 times of the repetition.

EXAMPLE 5

Using the same copper phthalocyanine and the disazo pigment (weight ratio 1:1) as the charge generating materials as used in Example 2 and adding diethylamine thereto, various charge generating material coating solutions having concentrations of 3 to 35% were prepared. Each coating solution was subjected to sufficient dispersion by using ultrasonic vibration, coated on an aluminum foil by using an applicator in the same manner as described in Example 1 and sufficiently dried to give a charge generating layer having a thickness as shown in Table 2. On the charge generating layer, a charge transport layer having the same composition as Example 2 and a thickness of 10 μm was formed to give a complex type electrophotographic plate.

Electrophotographic properties of these electrophotographic plates against white light were evaluated and listed in Table 2.

TABLE 2

| Thickness of charge generating layer (μm) | Initial voltage (V) | Dark decay (%) | Sensitivity (lux-sec) |
|---|---|---|---|
| 0.5 | 635 | 65 | 2.9 |
| 1.0 | 624 | 63 | 2.1 |
| 5.0 | 605 | 58 | 3.4 |
| 10.0 | 573 | 42 | 10.3 |
| 20.0 | 557 | 38 | 24.0 |

As shown in Table 2, the maximum sensitivity is obtained around the thickness of 1 μm and there is a tendency to decrease the sensitivity with an increase of the thickness.

EXAMPLE 6

A charge generating layer having a thickness of 3 μm was formed in the same manner as described in Example 1. Subsequently, to 0.15 part of 2,4,7-trinitrofluorenone, a charge transport material, and 0.3 part of Vylon 200 used in Example 2, a mixed solvent of dichloromethane and 1,2-dichloroethane (volume ratio 1:1) was added changing the adding amounts to give various complex type electrophotographic plates having various thickness of the charge transport layers as listed in Table 3.

Electrophotographic properties of these complex type electrophotographic plates were tested and the results were shown in Table 3.

TABLE 3

| Thickness of charge transport layer (μm) | Initial voltage (V) | Dark decay (%) | Sensitivity (lux-sec) |
|---|---|---|---|
| 5 | 540 | 61 | 3.0 |
| 10 | 605 | 63 | 3.1 |
| 20 | 670 | 60 | 3.8 |
| 30 | 720 | 57 | 5.2 |
| 50 | 737 | 55 | 7.7 |

As shown in Table 3, there is a tendency to increase the initial voltage with an increase of the thickness of the charge transport layer, whereas the sensitivity decreases in contrast.

EXAMPLE 7

Using 1 part of α-form copper pthalocyanine (Heliogen Blue 6840, manufactured by BASF A.G., West Germany), 1 part of the same disazo pigment as used in Example 2, and 1 part of butyral resin and the same method as described in Example 1, a charge generating layer having a thickness of 3 μm was formed. As the charge transport materials, the following pyrazoline derivative and oxadiazole derivative mentioned below and 2,4,7-trinitrofluorenone were used:

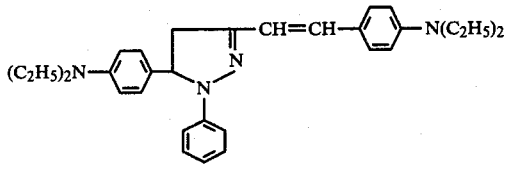

Pyrazoline derivative

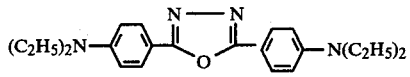

Oxadiazole derivative

To each 0.15 part of the charge transport materials mentioned above, 0.32 part of Iupilon S-2000, 0.003 part of dichloromethane and 0.001 part of 1,2-dichloroethane were added and mixed to give three kinds of charge transport material coating solutions as listed in Table 4. These coating solutions were coated on the charge generating layer in the same manner as described in Example 1 to give individual charge transport layers having a thickness of 10 μm.

Electrophotographic properties of the thus produced three kinds of complex type electrophotographic plates were tested and listed in Table 4.

TABLE 4

| Charge transport material | Initial voltage (V) | Dark decay (%) | Sensitivity (lux-sec) |
|---|---|---|---|
| Pyrazoline derivative | 603 | 52 | 8.8 |
| Oxadiazole derivative | 575 | 67 | 9.7 |
| 2,4,7-Trinitrofluorenone | 610 | 60 | 2.8 |

As shown above, relative high sensitivity can be obtained by the combination of a known pyrazoline derivative or oxadiazole derivative with the special charge generating material used in this invention, but remarkably high sensitivity is obtained by the combination of 2,4,7-trinitrofluorenone with the special charge generating material used in this invention.

EXAMPLE 8

On the same charge generating layer as used in Example 7, a charge transport material coating solution obtained by mixing 1 part of 2,4,7-trinitrofluorenone as a charge transport material, 0.5, 1, 3, 5 or 10 parts of Vylon 200 as listed in Table 5, and a mixed solvent of dichloromethane and 1,2-dichloroethane (volume ratio 1:1) so as to adjust the concentration of the charge transport material and the resin 8% in order to remove undesirable influence of the thickness was coated in the same manner as described in Example 1 to form a charge transport layer.

Electrophotographic properties of the thus produced five kinds of complex type electrophotographic plates were tested and listed in Table 5.

TABLE 5

| Amount of Vylon 200 (parts) | Initial voltage (V) | Dark decay (%) | Sensitivity (lux-sec) |
|---|---|---|---|
| 0.5 | 415 | 20 | 2.4 |
| 1 | 547 | 53 | 2.7 |
| 3 | 604 | 69 | 4.6 |
| 5 | 662 | 73 | 6.3 |
| 10 | 712 | 84 | 12.4 |

As shown above, when the amount of the resin increases, the initial voltage and the dark decay become better but the sensitivity becomes worse.

EXAMPLE 9

One part of β-form copper phthalocyanine (Fastogen Blue FGF, manufactured by Dainippon Ink and Chemicals, Inc., Japan), 1 part of the disazo pigment of the formula:

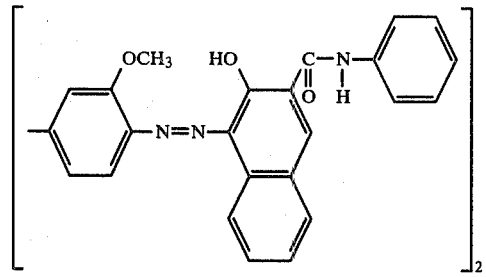

(Symular Fast Blue 4135, manufactured by Dainippon Ink and Chemicals, Inc., Japan) and 1 part of a butyral resin (XYHL, manufactured by Union Carbide Corp., U.S.A.) were mixed with xylene as a solvent so as to give a 6% solution and kneaded in a ball mill (a pot having a diameter of 10 cm, manufactured by Nippon Kagaku Togyo Co., Ltd., Japan) for 5 hours to give a charge generating material solution. This solution was coated on an aluminum foil of 100 μm thick by using an automatic applicator (manufactured by Toyo Seiki Co., Ltd., Japan) and dried to give a charge generating layer having a thickness of about 3 μm. Subsequently, 3 parts of a homopolymer of 9-(p-vinylphenyl)anthracene, and 2 parts of 2,4-dinitrofluorenone, both being charge transport materials, were dissolved in 0.04 part of toluene. The resulting solution was coated on the charge generating layer mentioned above by using the automatic applicator to give a charge transport layer having a thickness of about 8 μm.

The thus produced complex type electrophotographic plate had electrophotographic properties of an initial voltage of 650 V, dark decay of 52% and white light sensitivity of 3.0 lux-second, these values having no problem for practical use. Then the electrophotographic plate was charged positively in the dark with 5 kV for 10 seconds, exposed to scanning beams from a semiconductor laser of power 5 mW and wavelength 800 nm, and developed by using a cascade method to give a clear visible image.

EXAMPLE 10

A charge generating layer having a thickness of 3 μm was formed in the same manner as described in Example 1 but changing the mixing ratio of charge generating materials, ε-form copper phthalocyanine (Lionel Blue ESP, manufactured by Toyo Ink Co., Ltd., Japan) and the disazo pigment of the formula:

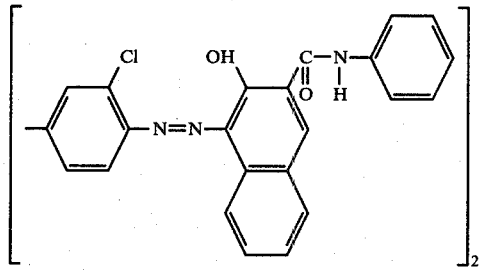

as shown in Table 1, using 1 part of the butyral resin per 2 parts of the charge generating material and using xylene as a solvent. A charge transport material solution was prepared by mixing 3 parts of 9-(p-vinylphenyl)- anthracene homopolymer, 2 parts of 2,4,7-trinitrofluorenone, both being charge transport materials, 1 part of a saturated polyester resin (Vylon 200, manufactured by Toyobo Co., Ltd., Japan), 20 ml of dichloromethane and 20 ml of 1,2-dichloroethane. In order to give a uniform coating, it was better to dissolve the resin component completely followed by the addition of the charge transport material. The resulting coating solution was coated on the charge generating layer mentioned above by using the automatic applicator and dried to give a charge transport layer having a thickness of 13 μm.

Electrophotographic properties against white light of the thus produced complex type electrophotographic plates were evaluated in the same manner as described in Example 1. The results were as shown in Table 6.

TABLE 6

| Mixing ratio of charge generating materials (weight ratio) | | Initial voltage (V) | Dark decay (%) | Sensitivity (lux-sec) |
|---|---|---|---|---|
| ε-Form copper phthalocyanine | Disazo pigment | | | |
| 4 | 0 | 780 | 34 | 4.0 |
| 3 | 1 | 795 | 42 | 1.2 |
| 2 | 2 | 755 | 53 | 1.8 |
| 1 | 3 | 760 | 58 | 2.0 |
| 0 | 4 | 790 | 62 | 4.4 |

As shown in Table 6, the sensitivity is increased when a mixture of charge generating materials is used compared with the single use of charge generating material. In order to understand the reason of this more clearly, spectral light-sensitivity of these electrohphotographic plates were measured. The results were as shown in FIG. 2. In FIG. 2, the curve A shows the case when ε-form copper phthalocyanine alone is used as a charge generating material, the curve B shows the case when ε-form copper phthalocyanine and the disazo pigment are used in a weight ratio of 3:1, the curve C shows the case when ε-form copper phthalocyanine and the disazo pigment are used in a weight ratio of 2:2, the curve D shows the case when ε-form copper phthalocyanine and the disazo pigment are used in a weight ratio of 1:3, and the curve E shows the case when the disazo pigment is used alone. As is clear from FIG. 2, when the disazo pigment, which is a charge generating material, is used alone (curve E), sensitivity is lost more than 700 nm of wavelength. In contrast, when the two kinds of charge generating materials are used as a mixture (curves B, C and D), not only the photosensitive wavelength range is broadened but also sensitivity at a wavelength more than 600 nm is particularly improved, these curves showing higher sensitivity than the curve A. Reasons for improving the properties when the mixture of ε-form copper phthalocyanine and the disazo pigment is used as charge generating materials seem to be that both the pigments have good affinity each other, the pigments are coated uniformly and the generation of light carriers at the time of exposure to light becomes good, but details are still unclear.

EXAMPLE 11

Using the same process as described in Example 1, a charge generating material coating solution was prepared from 1 part of β-form copper phthalocyanine (Heliogen Blue 7080, manufactured by BASF A.G., West Germany), 1 part of the monoazo Ca lake pigment of the formula:

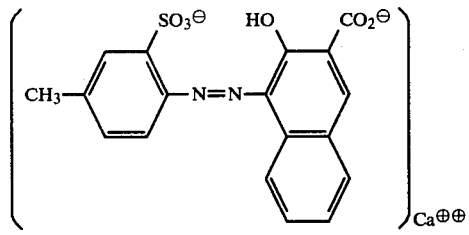

(Brilliant Carmine 6B, manufactured by Dianichi Seika Co., Ltd., Japan), 0.5 part of an acrylic resin (Elvacite 2045, manufactured by E. I. du Pont de Nemours Co., U.S.A.) and xylene as a solvent and a charge generating layer was formed therefrom. The resulting layer had a thickness of about 2.5 μm. Subsequently, 3 parts of brominated 9-(p-vinylphenyl)-anthracene polymer (bromination percent of 100% as monosubstituent on the anthracene nucleus) and 1 part of 2-nitrofluoroenone were dissolved in 0.02 part of tetrahydrofuran and the resulting solution was coated on the charge generating layer in the same manner as described in Example 1 to give a charge transport layer having a thickness of 20 μm.

The thus produced complex type electrophotographic plate had electrophotographic properties of an initial voltage of 790 V, dark decay of 51% and white light sensitivity of 2.6 lux-second, these values having no problem for practical use. Further, when the image forming test was conducted in the same manner as described in Example 1 by using a semiconductor laser, a clear image was obtained.

EXAMPLE 12

Using 1.5 parts of β-form copper phthalocyanine (Cyanine Blue LC, manufactured by Dainippon Ink and Chemicals, Inc., Japan) and 1 part of the disazo pigment as used in Example 2 and adding diethylamine thereto, various kinds of charge generating material solutions having concentrations of 3 to 35% were prepared. After sufficiently dispersing the charge generating materials by using ultrasonic vibration, each solution was coated on an aluminum foil by using an automatic applicator in the same manner as described in Example 1 and sufficiently dried to give a charge generating layer having a thickness as shown in Table 7. On each charge generating layer, a charge transport layer having the same composition as Example 1 was formed (the film thickness 8 μm).

Electrophotographic properties against white light of these thus produced complex type electrohphotographic plates were evaluated and listed in Table 7.

TABLE 7

| Thickness of charge generating layer (μm) | Initial voltage (V) | Dark decay (%) | Sensitivity (lux-sec) |
|---|---|---|---|
| 0.5 | 690 | 58 | 2.8 |
| 1.0 | 675 | 55 | 2.0 |
| 5.0 | 645 | 53 | 2.2 |
| 10.0 | 620 | 47 | 10.5 |
| 20.0 | 605 | 41 | 26.0 |

As shown in Table 7, the highest sensitivity is exhibited around the thickness of 1 μm and there is a tendency to decrease the sensitivity with an increase of the thickness.

EXAMPLE 13

Using the same process as described in Example 1, a charge generating layer having a thickness of 3 μm was obtained. Using the same charge transport materials as used in Example 11 and changing the amount of tetrahydrofuran, a solvent, various kinds of complex type electrophotographic plates having different thickness of charge transport layers as listed in Table 8 were obtained.

Electrohphotographic properties of these electrohphotographic plates were tested and listed in Table 8.

TABLE 8

| Thickness of charge transport layer (μm) | Initial voltage (V) | Dark decay (%) | Sensitivity (lux-sec) |
|---|---|---|---|
| 3 | 570 | 52 | 4.8 |
| 5 | 615 | 48 | 2.8 |
| 10 | 710 | 44 | 2.0 |
| 30 | 820 | 41 | 3.2 |
| 50 | 855 | 38 | 6.1 |
| 100 | 890 | 28 | 8.2 |

As shown in Table 8, when the thickness of the charge transport layer becomes larger, there is a tendency to enhance the initial voltage and to lower the sensitivity.

EXAMPLE 14

In a polymerization tube, 100 parts of a mixture of 9-(p-vinylphenyl)anthracene monomer and 9-vinyl carbazole monomer in 3:2 molar ratio, and 0.001 part of xylene solution containing 5% of di-tert-butyl peroxide were placed, sealed and heated at 130° C. for 15 hours to give a copolymer. Subsequently, to 1 part of 2,4,7-trinitrofluorenone, the copolymer mentioned above was added in an amount as listed in Table 9 together with 20 parts of xylene as a solvent to give a charge transport material solution. The charge transport material solution was coated on the same charge generating layer as obtained in Example 4 by using an automatic applicator to give a charge transport layer having a thickness of 10 μm.

Electrophotographic properties of the thus produced complex type electrophotographic plates were evaluated and listed in Table 9.

TABLE 9

| Amount of the copolymer (parts) | Initial voltage (V) | Dark decay (%) | Sensitivity (lux-sec) |
|---|---|---|---|
| 10 | 510 | 63 | 2.8 |
| 2 | 505 | 52 | 1.8 |
| 1 | 508 | 44 | 1.4 |
| 0.5 | 523 | 31 | 1.5 |
| 0.3 | 515 | 16 | 3.2 |

As shown in Table 9, when the amount of the copolymer of 9-(p-vinylphenyl)anthracene is decreased, there is a tendency to lower the dark decay.

EXAMPLE 15

To 2 parts of 9-(p-vinylphenyl)anthracene homopolymer and 1 part of 2,4,7-trinitrofluorenone as charge transport materials, the same saturated polyester resin as used in Example 2 was added in an amount of 1, 3, 6, 9 or 12 parts as listed in Table 10 and a mixed solvent of dichloromethane and 1,2-dichloroethane (volume ratio 1:1) was added thereto to give a charge transport material coating solution having a concentration of 8% of the charge transport material and the resin in order to remove influence of the thickness. The resulting coating solution was coated on the same charge generating layer as used in Example 1 by using an automatic applicator to give a charge transport layer having a thickness of 11 μm.

Electrohpotographic properties of the thus produced complex type electrophotographic plates were evaluated and listed in Table 10.

TABLE 10

| Amount of saturated polyester resin (parts) | Initial voltage (V) | Dark decay (%) | Sensitivity (lux-sec) |
|---|---|---|---|
| 1 | 672 | 51 | 2.0 |
| 3 | 710 | 51 | 2.6 |
| 6 | 740 | 54 | 3.1 |
| 9 | 795 | 57 | 4.0 |
| 12 | 875 | 61 | 6.3 |

EXAMPLE 16

To the same ε-form copper phthalocyanine as used in Example 2 in an amount of 1.5 parts, 48.5 parts of toluene was added and dispersion was conducted for 10 minutes by using ultrasonic vibration. The resulting solution was coated on a support in the same manner as described in Example 1 to form a charge generating layer having a thickness of about 0.1 μm. Subsequently, a charge transport material solution was prepared by mixing 1 part of 2,4,7-trinitrofluoreone, 9-(p-vinylphenyl)anthracene homopolymer in an amount as listed in Table 11, and 15 parts of tetrahydrofuran as a solvent. The resulting solution was coated on the charge generating layer similarly to give complex type electrophotographic plates.

Electrophotographic properties of these electrophotographic plates were evaluated and listed in Table 11.

TABLE 11

| Amount of 9-(p-vinylphenyl)-anthracene homopolymer (parts) | Initial voltage (V) | Dark decay (%) | Sensitivity (lux-sec) |
|---|---|---|---|
| 10 | 710 | 65 | 2.6 |
| 5 | 685 | 62 | 2.2 |
| 2 | 650 | 58 | 1.8 |
| 1 | 625 | 48 | 1.5 |
| 0.5 | 580 | 30 | 1.4 |
| 0.3 | 575 | 18 | 1.4 |

As shown in Table 11, when the amount of 9-(p-vinylphenyl)anthracene decreases, there is a tendency to increase the sensitivity but to decrease the initial voltage and the dark decay.

EXAMPLE 17

To 1 part of the same ε-form copper phthalocyanine as used in Example 2 and 1 part of monoazo Ba lake pigment of the formula:

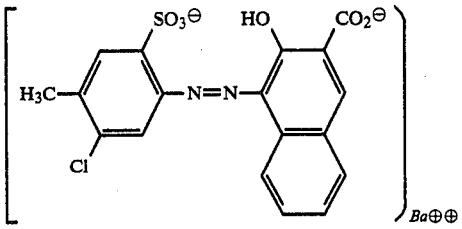

(Resino Red K, manufactured by Konishi Ganryo Ltd., Japan), diethylamine was added to give various kinds of charge generating material solutions having the charge generating material concentrations of 1 to 35%. These solutions were subjected to ultrasonic vibration dispersion so as to sufficiently disperse the charge generating materials. Subsequently, these solutions were coated on aluminum foils in the same manner as described in Example 1 by using an applicator and dried sufficiently to form charge generating layers having a thickness as listed in Table 12. On each charge generating layer, a charge transport layer having the same composition as in Example 10 and a thickness of 13 μm was formed to give a complex type electrophotographic plate.

Electrophotographic properties of the resulting electrophotographic plates were evaluated and listed in Table 12.

TABLE 12

| Thickness of charge generating layer (μm) | Initial voltage (V) | Dark decay (%) | Sensitivity (lux-sec) |
|---|---|---|---|
| 0.1 | 770 | 60 | 2.1 |
| 0.5 | 760 | 58 | 1.8 |
| 1.0 | 755 | 55 | 1.3 |
| 3.0 | 760 | 52 | 1.7 |
| 5.0 | 740 | 44 | 2.2 |
| 10.0 | 700 | 40 | 4.8 |

As shown in Table 12, the highest sensitivity can be seen at the thickness of about 1 μm, and there is a tendency to decrease the sensitivity smaller or larger than 1 μm.

Comparative Example

The same charge generating layer as used in Example 16 was formed on an aluminum foil in the same manner as described in Example 1. A charge transport material solution was prepared by mixing 2 parts of poly-N-vinylcarbazole, 1 part of 2,4,7-trinitrofluorenone and 20 parts of tetrahydrofuran. The resulting solution was coated on the charge generating layer in the same manner as described in Example 1 to give a charge transport layer having a thickness of 20 μm.

The thus produced complex type electrophotographic plate was subjected to an adhesion test. For comparison, the electrophotographic plate obtained in Example 16 was also tested. The results are as shown in Table 13.

TABLE 13

| Example No. | Example 16 (containing 2 parts of 9-(p-vinylphenyl)-anthracene homo-polymer) | Comparative Example |
|---|---|---|
| Mandrel test (%) | 0 | 27 |

Note Adhesion test:
After sticking a pressure-sensitive adhesive tape (NO 405, manufactured by Nichiban Co., Ltd., Japan) on an electrophotographic plate, the adhesive tape was peeled off by using a hand to a direction normal to the surface. Adhesive strength was evaluated by the ratio of the area of the photosensitive material layer remaining on the coated surface (in percents). The area peeled off is 5% or less is necessary from the viewpoint of practical use.

What is claimed is:

1. In a complex type electrophotographic plate comprising an electroconductive support and a photosensitive material layer containing a charge generating layer and a charge transport layer formed on the electroconductive support, the improvement wherein the charge generating layer contains a copper phthalocyanine and the charge transport layer contains (a) a nitrofluorenone and (b) at least one polycyclic aromatic vinyl polymer selected from the group consisting of a homopolymer of a polyacrylic aromatic vinyl compound, a copolymer of said polycyclic aromatic vinyl compound and one or more other vinyl compounds, a brominated homopolymer of said polycyclic aromatic vinyl compound and a brominated copolymer of said polycyclic aromatic vinyl compound and one or more of said other vinyl compounds, said polycyclic aromatic vinyl compound being represented by the formula:

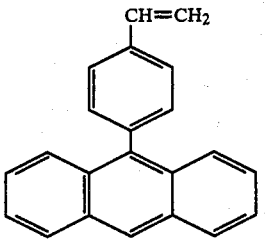

(III)

2. A complex type electrophotographic plate according to claim 1, wherein the charge generating layer contains ε-form copper phthalocyanine and the charge transport layer contains 2,4,7-trinitrofluorenone.

3. A complex type electrophotographic plate according to claim 1, wherein at least one of the charge generating layer and the charge transport layer contains a resin binder.

4. A complex type electrophotographic plate according to claim 1, wherein the charge generating layer contains ε-form copper phthalocyanine and the charge transport layer contains (a) 2,4,7-trinitrofluorenone and (b) at least one polycyclic aromatic vinyl polymer selected from the group consisting of 9-(p-vinylphenyl-)anthracene homopolymer, 9-(p-vinylphenyl)anthracene-N-vinyl carbazole copolymer, 9-(p-vinylphenyl-)anthracene-styrene copolymer, 9-(p-vinylphenyl)anthracene-acrylonitrile copolymer, 9-(p-vinylphenyl)anthracene-acrylate copolymers and 9-(p-vinylphenyl)anthracene-methacrylate copolymers.

5. A complex type electrophotographic plate according to claim 1 or 4, wherein the thickness of the charge generating layer is 0.1 to 5 μm and the thickness of the charge transport layer is 3 to 100 μm.

6. A complex type electrophotographic plate according to claim 5, wherein the polycyclic aromatic vinyl polymer is used in an amount of 0.3 to 10 parts by weight per part by weight of the nitrofluorenone.

7. A complex type electrophotographic plate according to claim 6, wherein at least one of the charge generating layer and the charge transport layer contains a resin binder.

8. A complex type electrophotographic plate according to claim 1, wherein the charge generating layer contains (c) ϵ-form copper phthalocyanine and (d) at least one azo pigment selected from the azo pigments of the formulae:

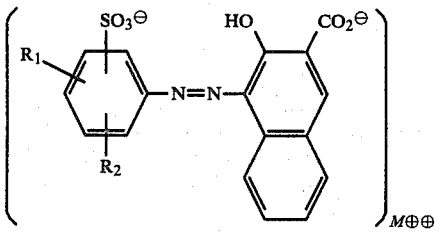

(I)

wherein M is Ca, Ba, or Mg; and $R_1$ and $R_2$ are independently hydrogen, —$OCH_3$ or halogen, and

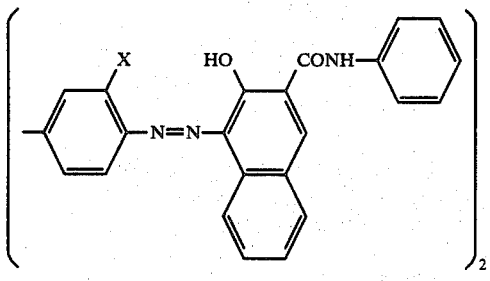

(II)

wherein X is —$OCH_3$ or Cl.

9. A complex type electrophotographic plate according to claim 8, wherein the thickness of the charge generating layer is 0.1 to 5 μm and the thickness of the charge transport layer is 3 to 100 μm.

10. A complex type electrophotographic plate according to claim 9, wherein the azo pigment is used in an amount of 0.1 to 10 parts by weight per part by weight of the copper phthalocyanine.

11. A complex type electrophotographic plate according to claim 10, wherein at least one of the charge generating layer and the charge transport layer contains a resin binder.

12. In a complex type electrophotographic plate comprising an electroconductive support and a photosensitive material layer containing a charge generating layer and a charge transport layer formed on the electroconductive support, the improvement wherein the charge generating layer contains (c) a copper phthalocyanine and (d) at least one azo pigment selected from the group consisting of monoazo lake pigments and disazo pigments, and the charge transport layer contains (a) a nitrofluorenone and (b) at least one polycyclic aromatic vinyl polymer selected from the group consisting of a homopolymer of a polycyclic aromatic vinyl compound, a copolymer of said polycyclic aromatic vinyl compound and one or more other vinyl compounds, a brominated homopolymer of said polycyclic aromatic vinyl compound and a brominated copolymer of said polycyclic aromatic vinyl compound and one or more of said other vinyl compounds, said polycyclic aromatic vinyl compound being represented by the formula:

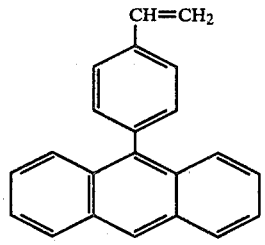

(III)

13. A complex type electrophotographic plate according to claim 12, wherein the charge generating layer contains (c) ϵ-form copper phthalocyanine and (d) at least one azo pigment selected from the azo pigments of the formulae:

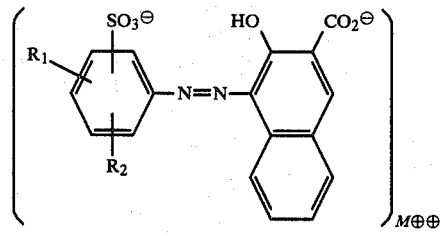

(I)

wherein M is Ca, Ba or Mg; and $R_1$ and $R_2$ are independently hydrogen, —$OCH_3$ or halogen, and

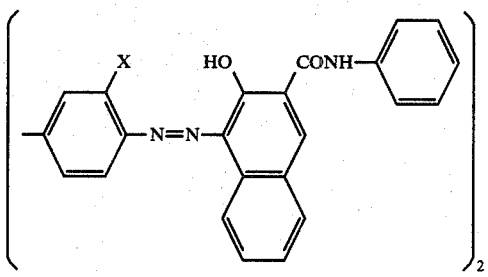

(II)

wherein X is —$OCH_3$ or Cl, and the charge transport layer contains (a) 2,4,7-trinitrofluorenone and (b) at least one polycyclic aromatic vinyl polymer selected from the group consisting of 9-(p-vinylphenyl)anthracene homopolymer, 9-(p-vinylphenyl)anthracene-N-vinyl carbazole copolymer, 9-(p-vinylphenyl)anthracene-styrene copolymer, 9-(p-vinylphenyl)anthracene-acrylonitrile copolymer, 9-(p-vinylphenyl)anthracene-acrylate copolymers and 9-(p-vinylphenyl)anthracene-methacrylate copolymers.

14. A complex type electrophotographic plate according to claim 12 or 13, wherein the thickness of the charge generating layer is 0.1 to 5 μm and the thickness of the charge transport layer is 3 to 100 μm.

15. A complex type electrophotographic plate according to claim 14, wherein the azo pigment is used in an amount of 0.1 to 10 parts by weight per part by weight of the copper phthalocyanine and the polycyclic aromatic vinyl polymer is used in an amount of 0.3 to 10 parts by weight per part by weight of the nitrofluorenone.

16. A complex type electrophotographic plate according to claim 15, wherein at least one of the charge generating layer and the charge transport layer contains a resin binder.

17. In an electrophotographic method comprising a first step of charging an electrophotographic plate, a second step of exposing the electrophotographic plate to light and a third step of developing an electrostatic latent image formed on the electrophotographic plate directly or the electrostatic latent image transferred to a recording medium, the improvement which comprises using in the first step, as the electrophotographic plate, a complex type electrophotographic plate having a charge generating layer containing a copper phthalocyanine and a charge transport layer containing (a) a nitrofluorenone and (b) at least one polycyclic aromatic vinyl polymer selected from the group consisting of a homopolymer of a polycyclic aromatic vinyl compound, a copolymer of said polycyclic aromatic vinyl compound and one or more other vinyl compounds, a brominated homopolymer of said polycyclic aromatic vinyl compound and a brominated copolymer of said polycyclic aromatic vinyl compound and one or more of said other vinyl compounds, said polycyclic aromatic vinyl compound being represented by the formula:

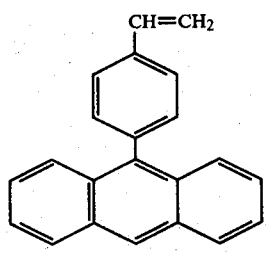

(III)

and charging said electrophotographic plate positively.

18. In an electrophotographic method comprising a first step of charging an electrophotographic plate, a second step of exposing the electrophotographic plate to light and a third step of developing an electrostatic latent image formed on the electrophotographic plate directly or the electrostatic latent image transferred to a recording medium, the improvement which comprises using in the first step, as the electrophotographic plate, a complex type electrophotographic plate having a charge generating layer containing (c) a copper phthalocyanine and (d) at least one azo pigment selected from the group consisting of monoazo lake pigments and disazo pigments, and a charge transport layer containing (a) a nitrofluorenone and (b) at least one polycyclic aromatic vinyl polymer selected from the group consisting of a homopolymer of a polycyclic aromatic vinyl compound, a copolymer of said polycyclic aromatic vinyl compound and one or more other vinyl compounds, a brominated homopolymer of said polycyclic aromatic vinyl compound and a brominated copolymer of said polycyclic aromatic vinyl compound and one or more of said other vinyl compounds, said polycyclic aromatic vinyl compound being represented by the formula:

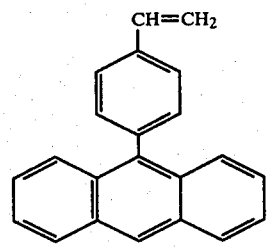

(III)

and charging said electrophotographic plate positively.

19. A method according to claim 18, wherein the thickness of the charge generating layer is 0.1 to 5 μm and the thickness of the charge transport layer is 3 to 100 μm, and at least one of the charge generating layer and the charge transport layer contains a resin binder.

* * * * *